US006713011B2

(12) United States Patent
Chu et al.

(10) Patent No.: US 6,713,011 B2
(45) Date of Patent: Mar. 30, 2004

(54) APPARATUS AND METHODS FOR ELECTROSPINNING POLYMERIC FIBERS AND MEMBRANES

(75) Inventors: Benjamin Chu, Setauket, NY (US); Benjamin S. Hsiao, Setauket, NY (US); Dufei Fang, Painted Post, NY (US)

(73) Assignee: The Research Foundation at State University of New York, Stony Brook, NY (US)

( * ) Notice: Subject to any disclaimer, the term of this patent is extended or adjusted under 35 U.S.C. 154(b) by 152 days.

(21) Appl. No.: 09/859,004

(22) Filed: May 16, 2001

(65) Prior Publication Data

US 2002/0175449 A1 Nov. 28, 2002

(51) Int. Cl.[7] ..... D01D 5/00; D01D 13/00; D06M 10/00

(52) U.S. Cl. ..... 264/465; 264/176.1; 425/135; 425/145; 425/166; 425/174.8 E; 425/224; 425/464

(58) Field of Search ..... 264/176.1, 465; 425/135, 145, 166, 174.8 E, 224, 464

(56) References Cited

U.S. PATENT DOCUMENTS

| | | | |
|---|---|---|---|
| 3,975,565 | A | 8/1976 | Kendall |
| 4,043,331 | A | 8/1977 | Martin et al. |
| 4,323,525 | A | 4/1982 | Bornat |
| 4,345,414 | A | 8/1982 | Bornat et al. |
| 4,468,922 | A | 9/1984 | McCrady et al. |
| 4,689,186 | A | 8/1987 | Bornat |
| 4,810,180 | A | 3/1989 | Isner |
| 4,878,908 | A | 11/1989 | Martin et al. |
| 4,911,867 | A | 3/1990 | Burlet et al. |
| 5,066,755 | A | 11/1991 | Lemstra |
| 5,296,172 | A | 3/1994 | Davis et al. |
| 5,569,528 | A | 10/1996 | Van der Loo et al. |
| 5,783,111 | A | 7/1998 | Ikkala et al. |
| 6,013,371 | A | 1/2000 | Hager et al. |
| 6,090,910 | A | 7/2000 | Shinoda et al. |
| 6,106,913 | A | 8/2000 | Scardino et al. |
| 6,218,441 | B1 | 4/2001 | Meluch et al. |

FOREIGN PATENT DOCUMENTS

| | | |
|---|---|---|
| WO | WO98/03267 A1 | 1/1998 |
| WO | WO01/26610 A1 | 4/2001 |
| WO | WO01/27365 A1 | 4/2001 |

OTHER PUBLICATIONS

Bezwada et al., "Poly(p–Dioxanone) and Its Copolymers," *Handbook of Biodegradable Polymers*, # 29–61 (1997).

Dzenis et al., "Polymer Hybrid Nano/Micro Composites," *Proceedings of the American Society for Composites–Ninth Technical Conference*, pp. 657–665 (1994).

*Primary Examiner*—Leo B. Tentoni
(74) *Attorney, Agent, or Firm*—Hoffmann & Baron, LLP

(57) ABSTRACT

An apparatus and method for electrospinning polymer fibers and membranes. The method includes electrospinning a polymer fiber from a conducting fluid in the presence of a first electric field established between a conducting fluid introduction device and a ground source and modifying the first electric field with a second electric field to form a jet stream of the conducting fluid. The method also includes electrically controlling the flow characteristics of the jet stream, forming a plurality of electrospinning jet streams and independently controlling the flow characteristics of at least one of the jet streams. The apparatus for electrospinning includes a conducting fluid introduction device containing a plurality of electrospinning spinnerets, a ground member positioned adjacent to the spinnerets, a support member disposed between the spinnerets and the ground member and movable to receive fibers formed from the conducting fluid, and a component for controlling the flow characteristics of conducting fluid from at least one spinneret independently from another spinneret.

50 Claims, 15 Drawing Sheets

FIG. 11 SPUN MEMBRANE WITH 1 WT% $KH_2PO_4$
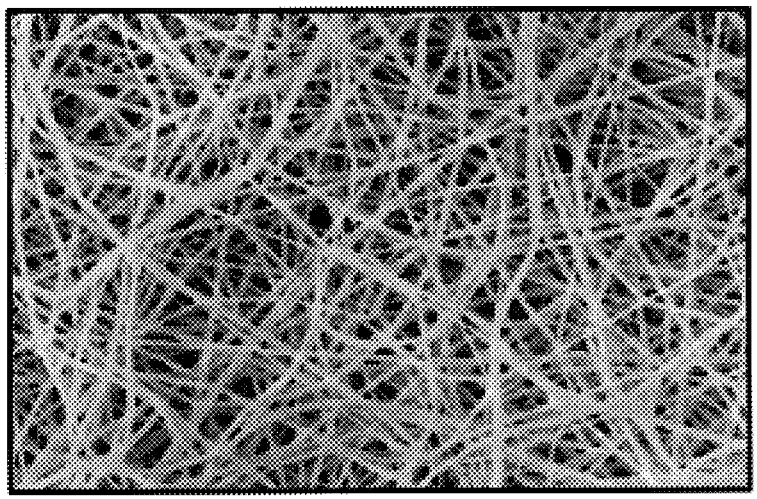
FIG. 12 SPUN MEMBRANE WITHOUT SALT
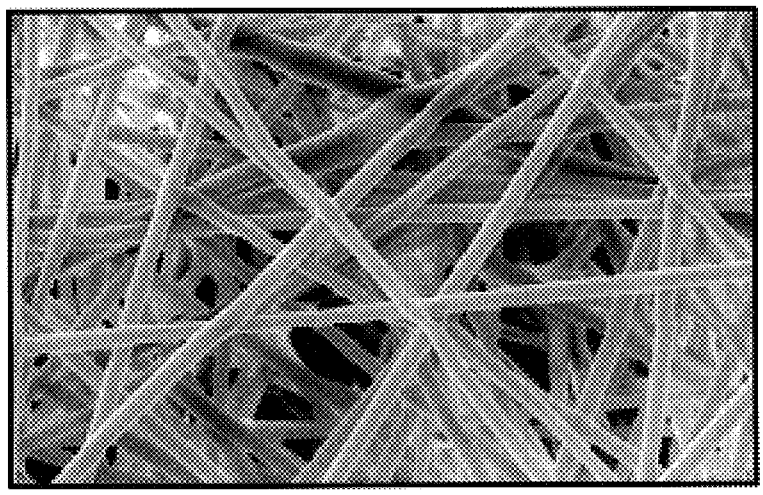

FIG. 14 SEM OF PAN MEMBRANE

FIG. 16 SEM IMAGE OF ELECTROSPUN PLA MEMBRANE
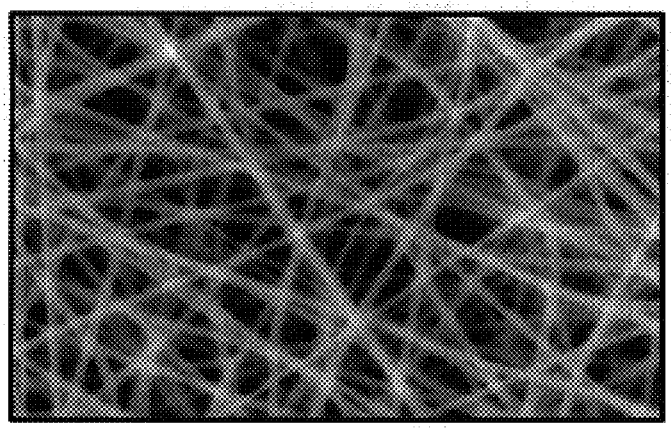

FIG. 17 DUEL THICKNESS PLA MEMBRANE
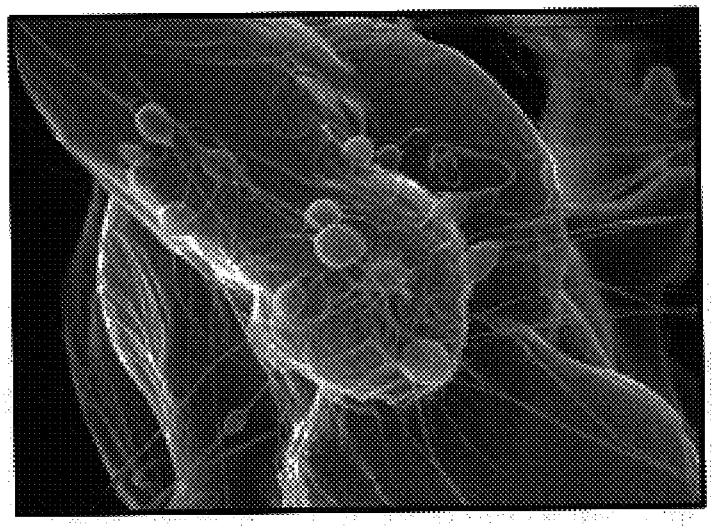
FIG. 18 SEM OF COPPER PLATED PAN MEMBRANE
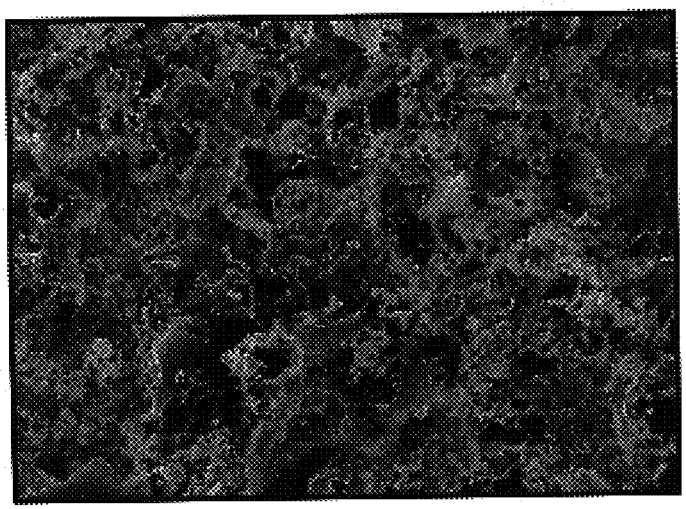

APPARATUS AND METHODS FOR ELECTROSPINNING POLYMERIC FIBERS AND MEMBRANES

BACKGROUND OF INVENTION

The present invention relates to an apparatus and methods for electrospinning polymer fibers and membranes.

Electrospinning is an atomization process of a conducting fluid which exploits the interactions between an electrostatic field and the conducting fluid. When an external electrostatic field is applied to a conducting fluid (e.g., a semi-dilute polymer solution or a polymer melt), a suspended conical droplet is formed, whereby the surface tension of the droplet is in equilibrium with the electric field. Electrostatic atomization occurs when the electrostatic field is strong enough to overcome the surface tension of the liquid. The liquid droplet then becomes unstable and a tiny jet is ejected from the surface of the droplet. As it reaches a grounded target, the material can be collected as an interconnected web containing relatively fine, i.e. small diameter, fibers. The resulting films (or membranes) from these small diameter fibers have very large surface area to volume ratios and small pore sizes. However, no practical industrial process has been implemented for electrospinning membranes containing a high percentage of small, e.g., nanosize, fibers. This is because with the production of small fibers, such as nanosize fibers, the total yield of the process is very low and a scale-up process, which maintains the performance characteristics of the films (or membranes), cannot be easily achieved.

U.S. Pat. No. 4,323,525 is directed to a process for the production of tubular products by electrostatically spinning a liquid containing a fiber-forming material. The process involves introducing the liquid into an electric field through a nozzle, under conditions to produce fibers of the fiber-forming material, which tend to be drawn to a charged collector, and collecting the fibers on a charged tubular collector which rotates about its longitudinal axis, to form the fibrous tubular product. It is also disclosed that several nozzles can be used to increase the rate of fiber production. However, there is no suggestion or teaching of how to control the physical characteristics of the tubular product, other than by controlling the charge and rotation speed of the tubular collector. For example, there is no teaching or suggestion of controlling jet formation, jet acceleration or fiber collection for individual jets. It is further noted that the spinning process of the '525 patent is used to fabricate tubular products having a homogenous fiber matrix across the wall thickness.

U.S. Pat. No. 4,689,186 is directed to a process for the production of polyurethane tubular products by electrostatically spinning a fiber-forming liquid containing the polyurethane. It is disclosed that auxiliary electrodes can be placed around the collector to help facilitate collection of the fibers. It is disclosed that the auxiliary electrodes can be arranged to facilitate separation or to prevent adhesion of the formed fibers. There is no teaching or suggestion of independently controlling jet formation, jet acceleration and fiber collection. It is also noted that the spinning process of the '186 patent is used to fabricate tubular products having a homogenous fiber matrix across the wall thickness.

The above mentioned references do not address the problems associated with producing membranes or other articles on an industrial scale, without adversely affecting the performance characteristics of the resulting products.

Thus, there is a need for improved electrospinning methods for producing fibers and membranes on an industrial scale which do not have the above-mentioned disadvantages.

SUMMARY OF INVENTION

According to the present invention, it has now been found that polymeric fibers can be produced by an elecrospinning process having improved control over fiber formation and transportation. In addition, membranes can be produced by electrospinning with the apparatus and according to the methods of the present invention on an industrial scale without the above-mentioned disadvantages.

In one aspect, the invention relates to a method for electrospinning a polymer fiber from a conducting fluid containing a polymer in the presence of a first electric field established between a conducting fluid introduction device and a ground source, which includes modifying the first electric field with a second electric field to form a jet stream of the conducting fluid. The conducting fluid introduction device is preferably a spinneret.

The second electric field can be established by imposing at least one field modifying electrode on the first electrostatic field. The field modifying electrode can be a plate electrode positioned between the conducting fluid introduction device and the ground source.

Preferably, the method includes feeding the conducting fluid to the conducting fluid introduction device at a controlled rate. The rate can be controlled by maintaining the conducting fluid at a constant pressure or constant flow rate.

In one embodiment, the method also involves controlling the electrical field strength at the spinneret tip by adjusting the electric charge on the field modifying electrode to provide a controlled diameter fiber.

In another embodiment, the method includes imposing a plurality of electrical field modifying electrodes to provide a controlled distribution of electrostatic potential between the spinneret and the ground source.

In another aspect, the invention relates to a method for electrospinning a polymer fiber from a conducting fluid containing a polymer in the presence of an electric field established between a spinneret and a ground source, which includes:

a) forming an electrospinning jet stream of the conducting fluid; and b) electrically controlling the flow characteristics of the jet stream.

The flow characteristics of the jet stream can be electrically controlled by at least one electrode. The flow characteristics of the jet stream can also be electrically controlled by at least one pair of electrostatic quadrupole lenses. Preferably, the flow characteristics of the jet stream are electrically controlled by a plurality of pairs of electrostatic quadropole lenses and, more preferably, by also using an alternating gradient technique.

In one embodiment, the method involves electrically controlling the flow characteristics of the jet stream to provide a controlled pattern over a desired target area. The controlled pattern can be provided by applying a waveform to the potential on at least one pair of electrostatic quadropole lenses.

In yet another aspect, the invention relates to a method for forming a controlled-dimension and controlled-morphology membrane by electrospinning a plurality of polymer fibers from conducting fluid containing a polymer in the presence of an electric field established between a solution introduction device and a ground source, in which the method includes:

a) forming a plurality of electrospinning jet streams of the conducting fluid; and b) independently controlling the flow characteristics of at least one of the jet streams.

Preferably, the flow characteristics of at least one of the jet streams are electrically controlled by at least one scanning electrode, more preferably, by at least one pair of scanning electrodes.

In one embodiment, the solution introduction device consists of a plurality of electrospinning spinnerets. Preferably, each spinneret produces an individual jet stream of the conducting fluid and, more preferably, the flow characteristics of each individual jet stream can be independently controlled.

Preferably, each spinneret has at least one scanning electrode for electrically controlling the flow characteristics of the individual jet stream. More preferably, each spinneret has two pairs of scanning electrodes for electrically controlling the flow characteristics of the individual jet stream.

It is contemplated that at least two spinnerets can deliver different solutions, wherein different solutions refers to different concentrations of polymer, different polymers, different polymer blends, different additives and/or different solvents.

In another aspect the invention is directed to an electrospinning apparatus for forming a membrane, which includes:

a conducting fluid introduction device for providing a quantity of conducting fluid containing a polymer, the conducting fluid introduction device containing a plurality of electrospinning spinnerets for delivering the conducting fluid, the spinnerets being electrically charged at a first potential;

a ground member positioned adjacent to the spinnerets and electrically charged at a second potential different from the first potential, thereby establishing an electric field between the spinnerets and the ground member;

a support member disposed between the spinnerets and the ground member and movable to receive fibers formed from the conducting fluid; and means for controlling the flow characteristics of conducting fluid from at least one spinneret independently from the flow characteristics of conducting fluid from another spinneret.

Preferably, the means for independently controlling the flow characteristics includes at least one electrode disposed adjacent each spinneret, each electrode being charged at a potential different from and separate from the first potential.

Preferably, each spinneret has two pairs of scanning electrodes for electrically separately controlling the flow characteristics of conducting fluid from the spinneret.

The means for independently controlling the flow characteristics can include a means for individually electrically turning on and off a respective spinneret. Preferably, the means for individually electrically turning on and off a respective spinneret contains at least one scanning electrode associated with each spinneret.

The means for independently controlling the flow characteristics can also contain a means for applying an alternating gradient to the conducting fluid delivered from the spinnerets. Preferably, the means for applying said alternating gradient includes a plurality of pairs of electrostatic quadropole lenses.

In one embodiment, the electrospinning apparatus includes a probe associated with at least one spinneret, the probe being disposed between the electrode and the ground member, the probe being electrically charged at a potential different from the spinneret and the electrode.

The electrospinning apparatus will preferably contain a pump for supplying conducting fluid to the conducting fluid introduction device at a predetermined pressure. The pump can also be adapted to control the supply rate of conductive fluid at a constant flow rate or at a constant pressure.

The electrospinning apparatus will preferably include a pump system for supplying different conducting fluids to at least two individual spinnerets.

In one embodiment, the conducting fluid introduction device contains a slit-die defining the plurality of spinnerets. The adjacent spinnerets can be interconnected by slits. In such an embodiment, the spinnerets can be defined by openings in the slit-die and the slits interconnecting the spinnerets are of configurations smaller than the openings. The apparatus can also contain a plurality of scanning electrodes disposed adjacent to each of the spinnerets.

In another embodiment, the solution introduction device includes a matrix defining the plurality of spinnerets, the spinnerets being disposed in the matrix in electrical isolation from each other. At least two individual spinnerets can be electrically charged to a different potential. The solution introduction device can also contain a plurality of individual electrodes in which at least one individual electrode is disposed adjacent to each individual spinneret. At least two individual electrodes can be electrically charged to a different potential.

In yet another aspect, the invention is directed to an apparatus for forming a membrane by electrospinning a plurality of polymer fibers from a conducting fluid which contains a polymer in the presence of an electric field between a conducting fluid introduction device and a ground source, in which the apparatus contains an improved conducting fluid introduction device which includes a plurality of spinnerets, each for independently delivering a controlled quantity of conducting fluid at a controlled pressure or flow rate, the spinnerets being charged at an electric potential and being disposed relative to each other to normally interfere with the electric field produced by adjacent spinnerets, each of the spinnerets having a tip at which conducting fluid exits configured to have an electrostatic field strength at each tip stronger than the liquid surface tension at each of the tips.

Each of the tips can be configured by having a tip with a selected geometric profile, a selected spatial relationship relative to other spinneret tips or a combination of both.

The apparatus containing the improved conducting fluid introduction device can also include an electrode associated with each spinneret configured to produce an electrical potential to at least partially screen electric field interference from adjacent spinnerets.

The apparatus containing the improved conducting fluid introduction device can also include a means for at least partially shielding a spinneret from electric field interference from adjacent spinnerets. The means for shielding can be a physical barrier disposed between adjacent spinnerets. The barrier will preferably have a conical shape.

The present invention provides an apparatus and methods for producing fibers and membranes by electrospinning with improved control over fiber formation and transportation. It also provides an apparatus and methods for producing membranes containing nanosize fibers on an industrial scale, without the above-mentioned disadvantages.

Additional objects, advantages and novel features of the invention will be set forth in part in the description and examples which follow, and in part will become apparent to those skilled in the art upon examination of the following, or may be learned by practice of the invention. The objects and advantages of the invention may be realized and attained by means of the instrumentalities and combinations particularly pointed out in the appended claims.

BRIEF DESCRIPTION OF THE FIGURES

FIG. 10 (*b*) is a cross-sectional view of the spinneret system of FIG. 11 (*a*) as seen along viewing line IV—IV thereof.

FIG. 10 (*c*) is a bottom view of the multiple spinneret system FIG. 11 (*a*).

FIG. 11 is an SEM of a PLA-co-PGA membrane spun from a solution containing 1 wt % $KH_2PO_4$.

FIG. 12 is an SEM of a PLA-co-PGA membrane spun from a solution without salt added.

FIG. 16 is an SEM of a PLA membrane described in Example 5.

FIG. 17 is an SEM of a dual thickness fiber PLA membrane described in Example 6.

FIG. 18 is an SEM of a copper plated PAN membrane described in Example 10.

DETAILED DESCRIPTION OF THE INVENTION

The present invention is directed to an apparatus and methods for producing polymeric fibers and membranes containing such fibers by electrospinning with improved control over fiber formation and transportation.

The present invention is also directed to an apparatus and methods for producing polymeric membranes by electrospinning a plurality of polymeric fibers simultaneously in a multiple jet system. This allows for high production rates and is necessary for a commercially viable process. However, in order to produce membranes by a multiple jet system, and maintain the desired performance characteristics of the membranes, it is necessary to control the flow characteristics of individual jet streams of the conducting fluid, as discussed more fully below.

By "flow characteristics" (of the conducting fluid) is meant the jet formation and jet acceleration of the conducting fluid which exits from the conducting fluid introduction device, e.g., the spinneret tip, as well as the directional flow of the jet stream in three dimensional space. Thus, controlling the flow characteristics can include controlling jet formation, controlling jet acceleration, directing the jet stream to a desired target in three dimensional space, steering the jet stream to different targets during the spinning process or a combination of these.

Nanofiber Fabrication Technique By Electrospinning

The invention is directed to improved methods and apparatus for electrospinning fibers and membranes from a conducting fluid containing a polymeric material.

Figure 1:
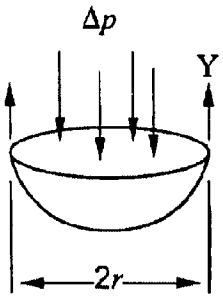
FIG. 1 is a schematic of a fluid drop created from a capillary.

The mechanical forces acting on the conducting fluid, which must be overcome by the interaction between an electrostatic field and the conducting fluid to create the electrospinning jet, can be understood by looking at a fluid drop in a capillary tube. For a fluid drop created from a capillary, as shown schematically in FIG. 1, a higher pressure is developed within the drop due to molecular interactions. This excess pressure $\Delta p$ inside the drop, which acts upon the capillary cross-section area $\pi r^2$, is counterbalanced by the surface tension Y acting on the circumference $2\pi r$, i.e. $\Delta p \cdot \pi r r^2 = Y \cdot 2\pi r$, or $$\Delta p = \frac{2Y}{r} \tag{1.1}$$

Formula 1.1 reveals that both the drop excess pressure $\Delta p$ and the surface energy per unit drop volume $(4\pi r^2 Y/[(4\pi/3)r^3]) = 3Y/r)$ become large when r is small.

Figure 2:
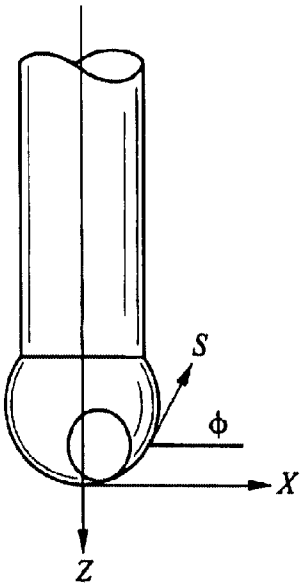
FIG. 2 is a schematic of a liquid drop suspended from a capillary.

The surface tension of a liquid drop hanging from a capillary tip (pendant drop), as shown schematically in FIG. 2, can be derived from the droplet shape, which is determined by a balance of all the forces acting upon the droplet, including gravity. The droplet surface tension can be related to the droplet shape as follows.

$$Y = g\Delta\rho r_0^2/\beta \tag{1.2}$$

where $\Delta\rho$ is the density difference between fluids at the interface ($\Delta\rho = \rho$ for the droplet having a liquid/air interface), g is the gravitational constant, $r_0$ is the radius of drop curvature at the apex and $\beta$ is the shape factor which can be defined by:

$$dx/ds = \cos\phi$$

$$dzds = \sin\phi$$

$$d\phi/ds = 2 + \beta z - \sin\phi/x \tag{1.3}$$

Numerical calculation can determine the value of $\beta$ accurately.

Figure 3:
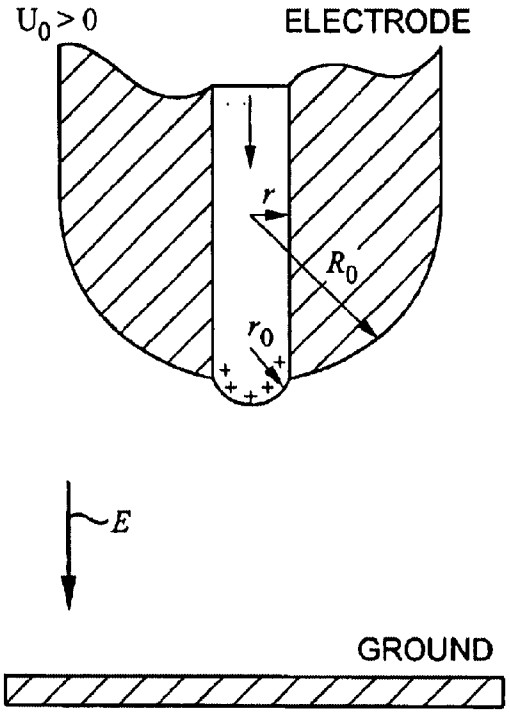
FIG. 3 is a schematic of a droplet from a single spinneret in an electric field.

A droplet from a single spinneret in an electrostatic field E, is shown schematically in FIG. 3. If a liquid has conductivity other than zero, the electric field will cause an initial current flow or charge rearrangement in the liquid. The positive charge will be accumulated at the surface until the net electric field in the liquid becomes zero. This condition is necessary for the current flow to be zero in the liquid. The duration $\tau$ of this flow is typically $\tau = \epsilon/\sigma$ where $\epsilon$ is the permitivity and $\sigma$ is the conductivity of the liquid. With a surface charge density (per unit area) $\rho_s$, the (surface) force $F_s$ exerted on the surface by the electrostatic field E on the droplet per unit area is:

$$F_s = \rho_s(\sigma)E \tag{1.4}$$

The conductivity $\sigma$ of the liquid can be adjusted, e.g., by adding an ionic salt. Thus, the surface charge density per unit area can be tuned accordingly. With a sufficiently strong electrostatic field at the tip, the surface tension Y can be overcome, i.e., $$F_s=\rho_s(\sigma)E\geqq Y-\rho_0 Vg \tag{1.5}$$

with $\rho_0$, V, and g being the density, the volume of the droplet and the gravitational acceleration, respectively. If this condition is met, the droplet shape will change at the tip to become the "Taylor" cone and a small jet of liquid will be emitted from the droplet. If the electrostatic field remains unchanged, the liquid moving away from the surface of the droplet will have net charges. This net excess charge is directly related to the liquid conductivity. Furthermore, the charged jet can be considered as a current flow, J(σ, E), which will, in turn, affect the electric field distribution on the tip of the droplet, i.e., $$E=E_0+E'(J) \tag{1.6}$$

with $E_0$ being the applied field threshold in the absence of fluid flow. For polymer solutions above the overlap concentration, the evenly distributed charges in the jet repel each other while in flight to the target (ground). Thus the polymer chains are continuously being "stretched" in flight until the stretch force is balanced by the chain restoring force or the chains are landed on the target, whichever comes first.

Figure 4:
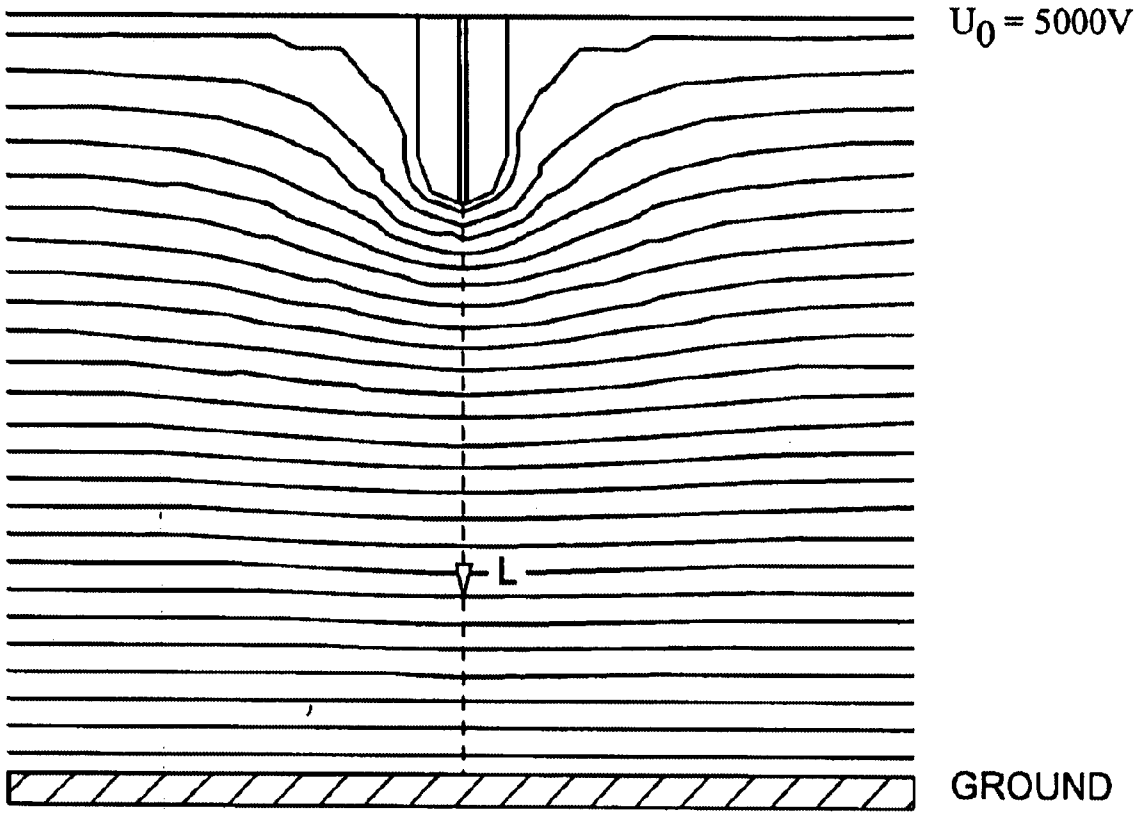
FIG. 4 is a schematic of the potential trajectory of a charged fluid jet from a single spinneret.
Figure 5:
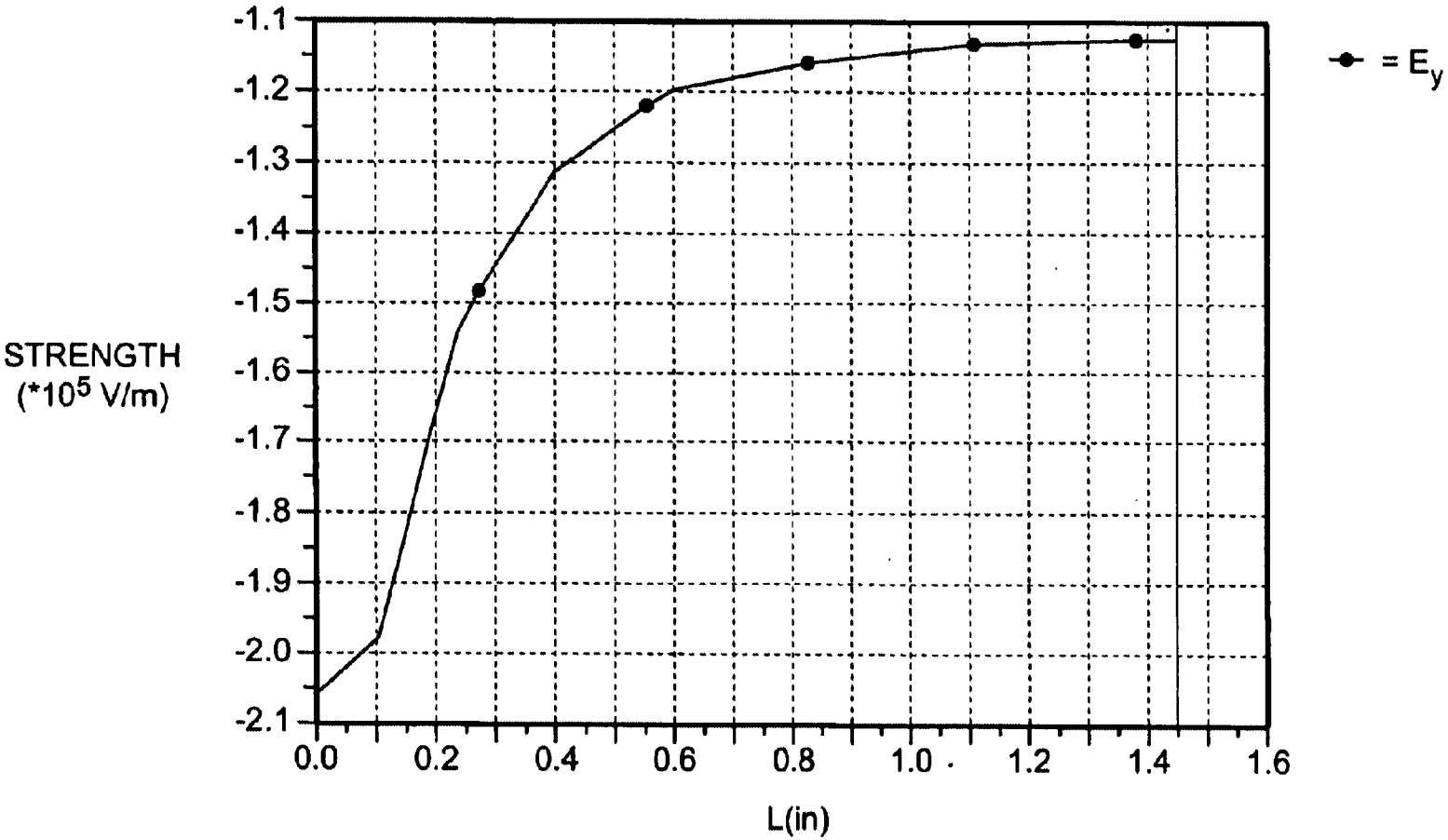
FIG. 5 is a graph of the electric field strength as a function of distance from the tip of a single spinneret.

In the electrospinning process according to the invention, a key requirement is to maintain the droplet shape. This requirement involves control of many parameters including liquid flow rate, electric and mechanical properties of the liquid, and the electrostatic field strength at the tip. In order to achieve high field strengths, the curvature of the electrode at the tip has to be sharp (small radius $R_0$). However, since a stable pendant droplet is controlled by the shape factor β, the curvature $r_0$ and thus $R_0$ could not be too small. FIG. 4 shows, as an example, estimates of equal potential lines of a single electrode configuration with a set of specific geometric parameters and the force line for a charge particle in the trajectory that is normal to the equal potential lines. FIG. 5 shows the estimated electric field strength along the jet direction from the tip of the electrode to the ground (plate).

Sub-micron diameter fibers can be produced in accordance with the invention at a relatively high yield. For example, a 40% polymer solution being spun from a spinneret with a diameter of 700 microns, which results in a final filament having a diameter of 250 nm, will have a draw ratio of $7.84\times10^6$. If the extrudate (conducting fluid) has a rate of about 20 μl/min, the final filament speed will be about 136 m/s, which is a relatively high spinning rate. Thus, a commercially viable process for making membranes according to the invention is achievable with a sufficient number of spinnerets operating at such speeds. For example, if a single jet is capable of processing a 40 wt % polymer solution at a rate of 20 μl/min (i.e. 8 mg/min), then a production unit of 100 jets can produce about 500 g of a membrane in 12 hours of operation. As the average membrane density is about 0.25 g/cm$^3$ and the average membrane thickness is about 25 microns, about 160 sheets of a membrane (with dimensions of 20×25 cm$^2$) can be produced per day.

The conducting fluid will preferably include a solution of the polymer materials described more fully below. The polymer material used to form the membrane is first dissolved in a solvent. The solvent can be any solvent which is capable of dissolving the polymer and providing a conducting fluid capable of being electrospun. Typical solvents include a solvent selected from N,N-Dimethyl formamide (DMF), tetrahydrofuran (THF), methylene chloride, dioxane, ethanol, chloroform, water or mixtures of these solvents.

The conducting fluid can optionally contain a salt which creates an excess charge effect to facilitate the electrospinning process. Examples of suitable salts include NaCl, $KH_2PO_4$, $K_2HPO_4$, $KIO_3$, KCl, $MgSO_4$, $MgCl_2$, $NaHCO_3$, $CaCl_2$ or mixtures of these salts.

The polymer solution forming the conducting fluid will preferably have a polymer concentration in the range of about 1 to about 80 wt %, more preferably about 10 to about 60 wt %. The conducting fluid will preferably have a viscosity in the range of about 50 to about 2000 mPa·s, more preferably about 200 to about 700 mPa·s.

The electric field created in the electrospinning process will preferably be in the range of about 5 to about 100 kilovolts (kV), more preferably about 10 to about 50 kV. The feed rate of the conducting fluid to the spinneret (or electrode) will preferably be in the range of about 0.1 to about 1000 microliters/min, more preferably about 1 to about 250 microliters/min.

Preferably the electospinning process includes multiple jets. This allows for the production of membranes containing small diameter fibers in very high yield, making it useful for production on an industrial scale. However, there are constraints associated with trying to use multiple jets in an electrospinning process.

Figure 6:
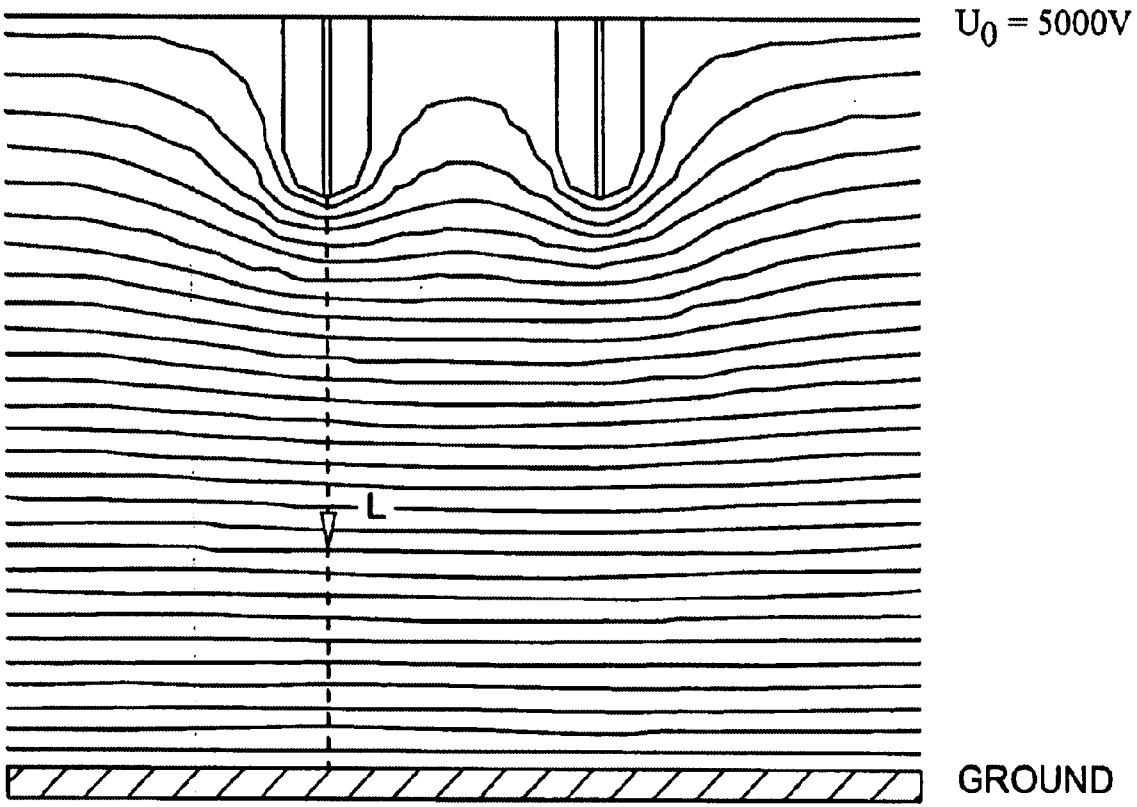
FIG. 6 is a schematic of the potential trajectory of charged fluid jets from a multiple spinnerets.

For a configuration with multiple jets, two main factors are to be considered: 1) the liquids should be delivered, either at constant pressure or constant flow rate, to each separate spinneret; and 2) the electrostatic field strength at each tip of the electrode should be strong enough to overcome the liquid surface tension at that tip. The first factor has been resolved by careful mechanical design for controlled solution distribution to each of the spinnerets. With electrodes being placed close to one another, the electrostatic field distribution is changed and the field strength at tip is normally weakened because of the interference from nearby electrodes, i.e., $$E_i = E_i^0 + \sum_{j\neq i} E_{ij} + \sum_j E'_{ij}(J_j) \tag{1.7}$$

where $E_i^0$ is the unperturbed electric field strength due to the single electrode i. $E_{ij}$ is the electric field at location i contributed by electrode j, and $E'_{ij}(J_j)$ is the interference electric field caused by the current J of jet j. FIG. 6 shows the equal potential line of a double jet configuration with the electrodes having the geometrical parameters as that of a single jet.

By following Equation (1.5) for a single jet, the criteria for the multiple jet operation are that, in addition to Equation (1.7), each jet (i) has to meet the following condition:

$$\rho_s^i(\sigma_i)E_i\geqq Y_i-\rho_0^i V_i g \tag{1.8}$$

Figure 7:
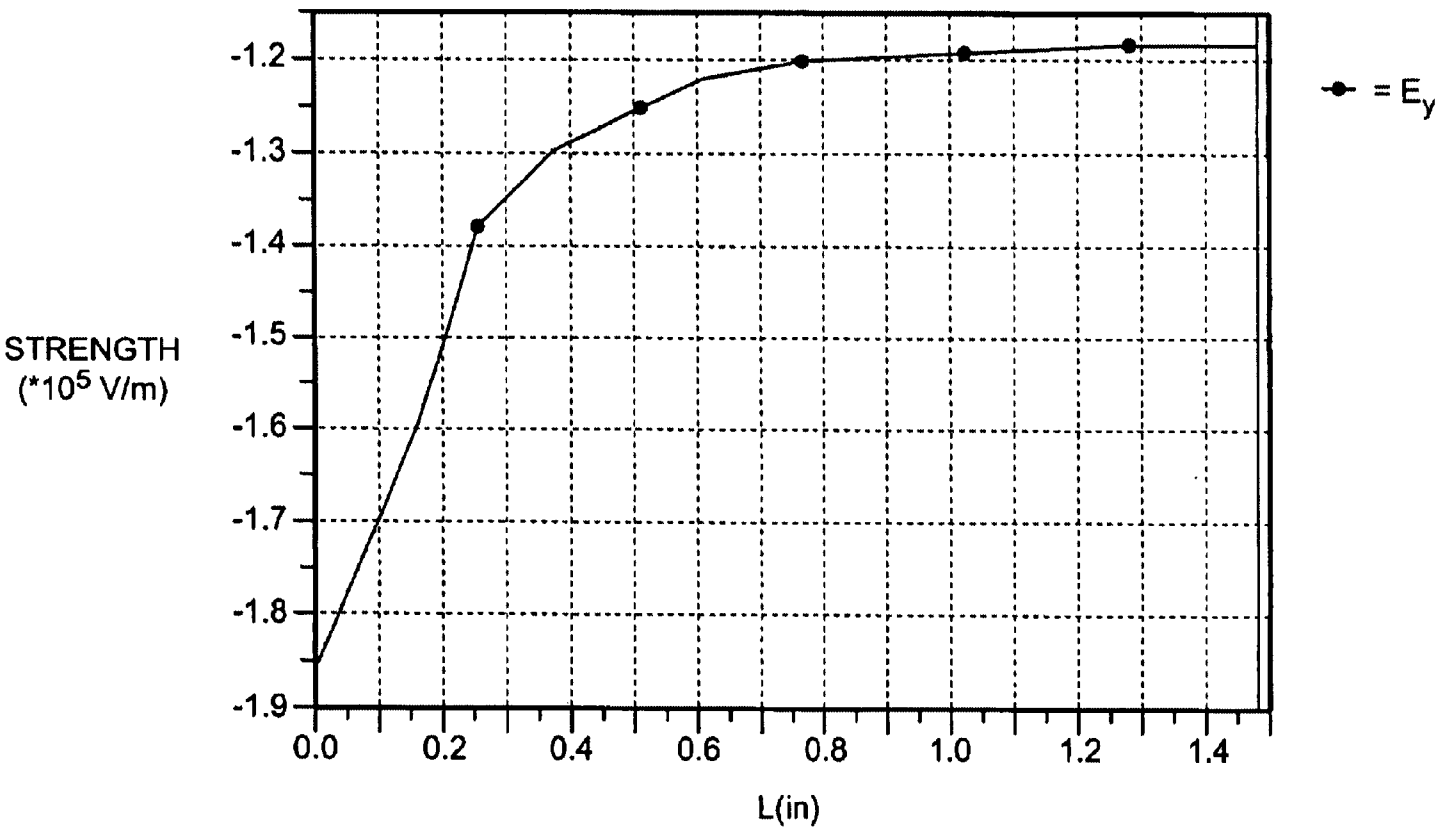
FIG. 7 is a graph of the electric field strength as a function of distance from the tip of a spinneret in a multiple spinneret system.

Both conditions for Equations (1.7) and (1.8) should be met for multiple jet operation. The multiple jet apparatus of the present invention was based on these two criteria. For example, FIG. 7 shows the estimated electric field strength along the direction from the tip to the ground. In comparison with FIG. 5, the field strength is less in absolute value. A separate calculation could show that in order to achieve the same field strength as the original unperturbed single jet, the electric potential has to increase from 5.0 kV to 5.6 kV. This demonstrates that the electric field strength for multiple jets can be calculated by using Equation (1.7). Furthermore, a shielding system or a specially shaped electrode to produce a different electric potential may be used to partially screen out the interference from nearby electrodes, making the scale up operation practical. Numerical estimates, including jet effects based on Equation (1.7), can be used to guide and to obtain an optimal design for specific operations.

With multiple jets, as the electrodes are placed close to one another, the electrostatic field distribution is changed and the field strength of the spinneret i at the tip is altered by the presence of nearby electrodes. The net field strength at the tip i can be represented by three combinations: (1) the unperturbed electric field strength due to the single electrode i, (2) the sum of the electric field strength at location i due to all other electrodes, and (3) the electric field strength at location i generated by all jets (including i). This net field strength at tip i (Ei) can then be used to set the criteria for electrospinning, i.e., the product of surface charge density of the conducting fluid at tip i ($S_i$) times $E_i$ together with the gravity effect should overcome the surface tension of the field at tip i. These rules represent the fundamental criteria for efficient multiple jet operation and permit optimal design for specific operations that involve multiple parameter adjustments.

In accordance with the present invention, different approaches have been developed to provide for efficient multiple jet operation. These approaches include improvements in the multiple jet electrospinning apparatus to provide sufficient field strength to overcome the surface tension of the conducting fluid and the electric field interference from adjacent spinnerets and jet streams. For example, a spinneret tip configuration can be provided to allow for efficient multiple jet spinning. The spinneret tip configuration can include a selected geometric profile to provide a controlled charge distribution in the conducting fluid at the spirmeret tip as discussed above. The spinneret tip configuration can also include a selected spatial relationship for the spinneret tips relative to each other. For example, the distance from individual spinneret tips to the ground source can be varied, depending upon the relative distance between adjacent spinnerets, to provide more efficient multiple jet spinning.

Another example of an improved electrospinning apparatus is to provide an electrode associated with each spinneret configured to produce an electrical potential to at least partially screen electric field interference from adjacent spinnerets. Another example includes providing a means for at least partially shielding the electric field interference, such as a physical barrier disposed between adjacent spinnerets.

Figure 8:
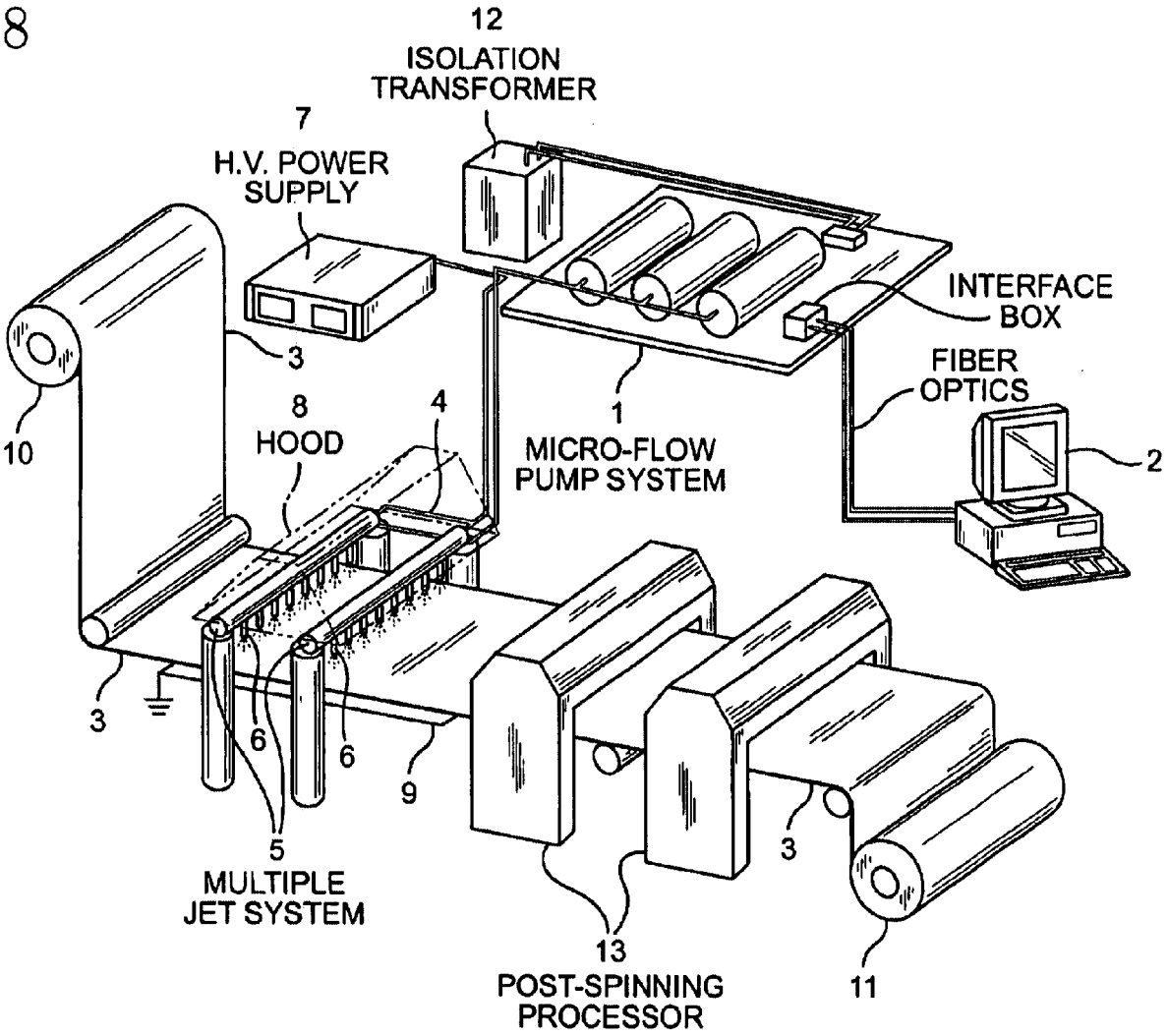
FIG. 8 is a schematic of an electrospinning system.

A particular apparatus for producing membranes according to the present invention, which uses a multiple jet electrospinning system, is shown schematically in FIG. 8. Equipment not essential to the understanding of the invention such as heat exchangers, pumps and compressors and the like are not shown.

Referring now to FIG. 8, the conducting fluid, which contains the polymer, is supplied by a micro-flow pump system 1. The conducting fluid preferably contains a polymer, a solvent and a salt, e.g., 25 wt % PLA-DMF solution with 1 wt % $KH_2PO_4$. The pump system 1 is linked to a computer 2 which controls the flow rate of the conducting fluid by controlling pressure or flow rate. Optionally, different flow rates can be provided and controlled to selected spinnerets. The flow rate will change depending upon the speed of the support membrane 3 and the desired physical characteristics of the membrane, i.e., membrane thickness, fiber diameter, pore size, membrane density, etc.

The pump system 1 feeds the conducting fluid to a multiple jet system 4 that contains manifolds 5 having a bank of spinnerets 6. The spinnerets each have a tip geometry which allows for stable jet formation and transportation, without interference from adjacent spinnerets or jet streams. A charge in the range of about 20 to about 50 kV is applied to the spinnerets by a high voltage power supply 7. A hood 8 is positioned over the multiple jet system 4 to remove the solvent at a controlled evaporation rate.

A ground plate 9 is positioned below the multiple jet system 4 such that an electric field is created between the charged spinnerets 6 and the ground plate 9. The electric field causes tiny jets of the conducting fluid to be ejected from the spinnerets and spray towards the ground plate 9, forming small, e.g. sub-micron, diameter filaments or fibers.

A moving support membrane 3 is positioned between the charged spinnerets 6 and the ground plate 9 to collect the fibers which are formed from the spinnerets and to from an interconnected web of the fibers. The support membrane 3 moves in the direction from the unwind roll 10 to the rewind roll 11.

The micro-flow control/pumping system is electrically isolated from the ground and is powered by an isolation transformer 12.

The post-spinning processors 13 have the functions of drying, annealing, membrane transfer (for example, from a stainless mesh substrate to another substrate, e.g., a Malox mesh) and post-conditioning.

Post-conditioning can include additional processing steps to change the physical characteristics of the membrane itself, e.g., post-curing, or to modify the membrane by incorporating other materials to change the properties of the resulting membrane, e.g., solution coating, spin casting or metal/metal oxide plating the membrane.

Multiple jets with designed array patterns can be used to ensure the fabrication of uniform thickness of the membrane. Hood, heating and sample treatment chambers can also be included to control the solvent evaporation rate and to enhance the mechanical properties. The recovered thickness can be precisely controlled from tens of microns to hundreds of microns. Additional embodiments or modifications to the electrospinning process and apparatus are described below.

Variation of Electric/mechanical Properties of Conducting Fluid

The properties of the resulting membrane produced by electrospinning will be affected by the electric and mechancial properties of the conducting fluid. The conductivity of the macromolecular solution can be drastically changed by adding ionic inorganic/organic compounds. The magnetohydrodynamic properties of the fluid depend on a combination of physical and mechanical properties, (e.g., surface tension, viscosity and viscoelastic behavior of the fluid) and electrical properties (e.g., charge density and polarizability of the fluid). For example, by adding a surfactant to the polymer solution, the fluid surface tension can be reduced, so that the electrostatic fields can influence the jet shape and the jet flow over a wider range of conditions. By coupling a pump system that can control the flow rate either at constant pressure or at constant flow rate, the effect of viscosity of the conducting fluid can be alleviated.

Electrode Design

In another embodiment for producing membranes according to the present invention, the jet formation process during electrospinning is further refined to provide better control over fiber size. Instead of merely providing a charged spinneret and a ground plate, as discussed above, a positively charged spinneret is still responsible for the formation of the polymer solution droplet and a plate electrode with a small exit hole in the center is responsible for the formation of the jet stream. This exit hole will provide the means to let the jet stream pass through the plate electrode. Thus, if the polymer droplet on the positively charged spinneret has a typical dimension of 2–3 mm and the plate electrode is placed at a distance of about 10 mm from the spinneret, a reasonable electrostatic potential can be developed. The short distance between the two electrodes implies that the electrostatic potential could be fairly low. However, the resultant electric field strength could be sufficiently strong for the electrospinning process. By varying the electric potential of the spinneret, the jet formation can be controlled and adjusted. Such an electrode configuration should greatly reduce the required applied potential on the spinneret from typically about 15 kilovolts (kV) down to typically about 1.5 to 2 kV (relative to the ground plate potential). The exact spinneret potential required for stable jet formation will depend on the electric/mechanical properties of the specific conducting fluid.

Control of Jet Acceleration and Transportation

In another preferred embodiment for producing membranes according to the present invention, the jet stream flight is also precisely controlled. The jet stream passing through the plate electrode exit hole is positively charged. Although this stream has a tendency to straightening itself during flight, without external electric field confinement the jet will soon become unstable in its trajectory. In other words, the charged stream becomes defocused, resulting in loss of control over the microscopic and macroscopic properties of the fluid. This instability can be removed by using a carefully designed probe electrode immediately after the plate electrode and a series of (equally) spaced plate electrodes. The electrode assembly (or composite electrode), i.e., the probe electrode and the plate electrodes, can create a uniform distribution of electrostatic potential along the (straight) flight path. The acceleration potential is formed by placing the base potential of the spinneret at about +20 to +30 kV above the target (at ground potential) while the electrostatic potential of the probe electrode can be adjusted to slightly below the plate electrode base potential. The composite electrodes are capable of delivering the jet stream to a desired target area. The composite electrode can also be utilized to manipulate the jet stream. By changing the electrostatic potential, the jet stream acceleration is altered, resulting in varying the diameter of the formed nano-fiber. This electrostatic potential variation changes the jet stream stability, and therefore, corresponding changes in the composite electrode can be used to stabilize the new jet stream. Such a procedure can be used to fine-tune and to change the fiber diameter during the electrospinning process.

Jet Manipulation

In yet another embodiment, the jet stream can be focused by using an "Alternating Gradient" (AG) technique, widely used in the accelerator technology of high-energy physics. The basic idea is to use two pairs of electrostatic quadrupole lenses. The second lens has the same geometric arrangement as the first lens with a reversed (alternate) electric gradient. The positively charged jet stream will be focused, for example, in the xz plane after the first lens and then be refocused in the yz plane after the second lens. It is noted that the z-direction represents the direction of the initial flight path. By applying an additional triangle-shaped waveform to the potential on one of the pairs of the quadrupole, the jet can be swept across the target area, allowing the control of the direction of the jet stream. Furthermore, with varying waveform of the 'sweep' potential, a desired pattern on the target can be formed.

Pattern Design by Electrospinning

Figure 9:
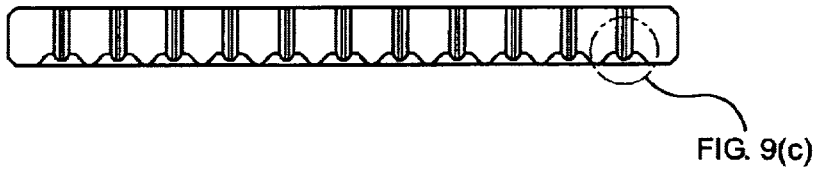
FIG. 9 is a schematic of an array of spinnerets for an electrospinning process.
Figure 9:
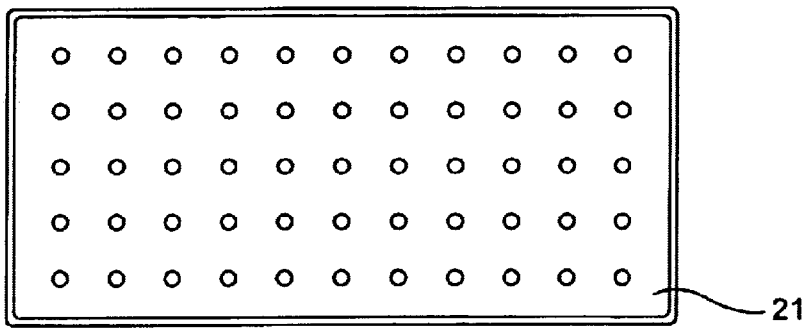
Figure 9:
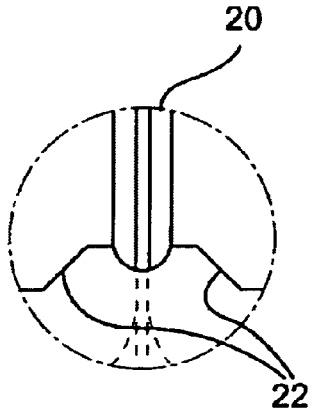

In yet another embodiment for producing membranes according to the present invention, reference will be made to FIG. 9. In this embodiment, the conducting fluid is introduced into the electrospinning process through an array of electrospinning spinnerets 20. The array of electrospinning spinnerets are assembled in a matrix 21 that provides electrical isolation for the spinnerets, with each spinneret having two pairs (X and Y direction) of miniature scanning electrodes 22. The spinneret 20 and the scanning electrodes 22 are electrically wired such that each individual polymer solution jet can be turned on and off and be steered to a finite size target area. As each spinneret 20 can be turned on/off independently by electricity, the response time will be relatively fast. Also, each spinneret 20 can deliver a different solution, e.g., each containing a different drug or concentration. A designed pattern can be obtained in the resultant membrane. This pattern can be precisely controlled by a computer and can be tailored for specific medical applications.

Multiple Jet Slit-Die Geometry

Figure 10:
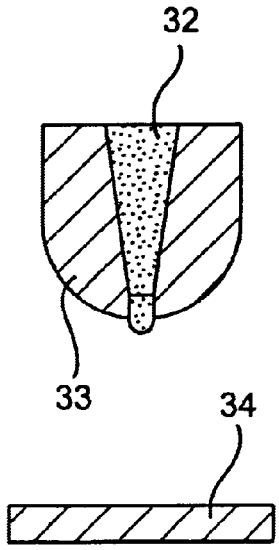
FIG. 10 (*a*) is a side view schematic of a multiple spinneret system for producing membranes in accordance with the invention.
Figure 10:
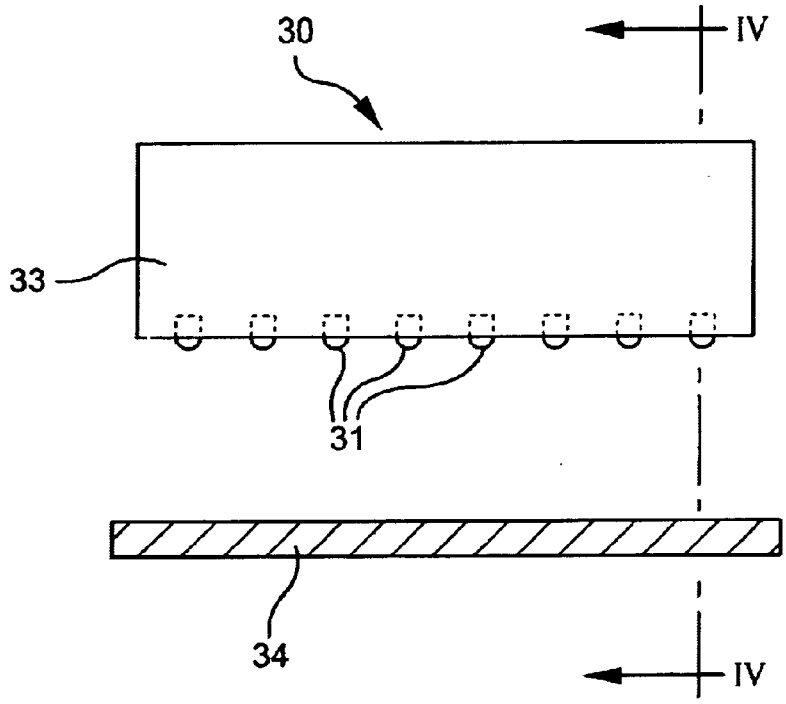
Figure 10:
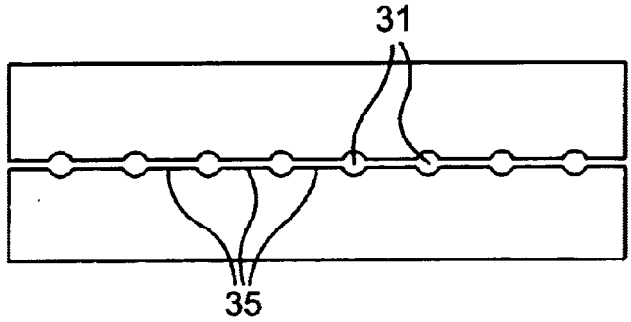

In yet a further embodiment for producing membranes in accordance with the present invention, reference is made to FIGS. 10(*a*)–10(*c*). In this embodiment, a multiple jet system 30 comprises an array of electrospinning spinnerets 31, each spinneret 31 being defined by a slit 32 formed in a slit-die 33 that is coupled to high voltage to serve as an electrode disposed above the ground plate 34. As shown in detail in FIG. 10(*c*), the spinnerets 31 are each interconnected by selectively narrow slits 35, such that each spinneret 31 is interconnected to a neighboring spinneret 31 by a slit 35. The conducting fluid will not flow through the slits 35, but will flow through each of the spinnerets 31 in a more robust manner.

The slit-die approach permits three distinct advantages that are not available by using individual spinnerets. First, the slit-die is made up of two separate components with controlled dimensions of the effective openings for the spinnerets. In other words, by changing the distance between the two components, the effective openings of the spinnerets become available. Second, the presence of slits between the larger openings permits fluid flow and thereby equalizes the pressure difference between the spinnerets. Third, the presence of slits can also reduce potential blockage of the fluid.

The membranes produced by the slit-die approach can achieve a larger degree of flexibility in the structures. For example, different size nanofibers can be produced from the same slit-die setup.

Control of Degradation Rate through Processing Parameters

As discussed above, very different fiber diameter and morphology in the membrane can be obtained by changing the parameters in the electrospinning process. As the degradation rate is inversely proportional to the fiber diameter, the manipulation capability through processing parameters provides not only the means to control the degradation rate of the membrane but also the ways to control drug loading efficiency and the drug release rate.

For example, it is believed that a change in charge density (through the addition of salts) can significantly affect the fiber diameter. When 1 wt % potassium phosphate ($KH_2PO_4$) was added to a PLA-co-PGA solution, the fiber diameter became much thinner (see SEM picture in FIG. 11) than the one with no salt added (FIG. 12). Thus, it is believed that higher excess charge density generally favors the production of thinner fibers and lower excess charge density favors the production of thicker fibers. Several other kinds of salts (e.g. NaCl, $KH_2PO_4$, KIO and $K_3PO_4$), which are all biologically compatible to the body, are also contemplated.

The apparatus and methods according to the invention can be used for electrospinning any fiberizable material.

Examples of such materials include polymers, such as PLA, PGA, PEO, nylon, polyesters, polyamides, poly(amic acids), polyimides, polyethers, polyketones, polyurethanes, polycaprolactones, polyacrylonitriles and polyaramides.

The fiberizable material is preferably a biodegradable or bioabsorbable polymer, when it is desired to produce membranes for medical applications. Examples of suitable polymers can be found in Bezwada, Rao S. et al. (1997)*Poly(p-Dioxanone) and its copolymers, in Handbook of Biodegradable Polymers*, A. J. Domb, J. Kost and D. M. Wiseman, editors, Hardwood Academic Publishers, The Netherlands, pp. 29–61, the disclosure of which is incorporated herein by reference in its entirety.

In an embodiment for preparing membranes useful in medical applications the polymer is a biodegradable and/or bioabsorbable polymer which contains a monomer selected from the group consisting of a glycolid, lactide, dioxanone, caprolactone and trimethylene carbonate. By the terminology "contains a monomer" is intended a polymer which is produced from the specified monomer(s) or contains the specified monomeric unit(s). The polymer can be a homopolymer, random or block co-polymer or heteropolymer containing any combination of these monomers. The material can be a random copolymer, block copolymer or blend of homopolymers, copolymers, and/or heteropolymers that contains these monomers.

In one embodiment, the biodegradable and/or bioabsorbable polymer contains bioabsorbable and biodegradable linear aliphatic polyesters such as polyglycolide (PGA) and its random copolymer poly(glycolide-co-lactide) (PGA-co-PLA). The FDA has approved these polymers for use in surgical applications, including medical sutures. An advantage of these synthetic absorbable materials is their degradability by simple hydrolysis of the ester backbone in aqueous environments, such as body fluids. The degradation products are ultimately metabolized to carbon dioxide and water or can be excreted via the kidney. These polymers are very different from cellulose based materials, which cannot be absorbed by the body.

Other examples of suitable biocompatible polymers are polyhydroxyalkyl methacrylates including ethylmethacrylate, and hydrogels such as polyvinylpyrrolidone, polyacrylamides, etc. Other suitable bioabsorbable materials are biopolymers which include collagen, gelatin, alginic acid, chitin, chitosan, fibrin, hyaluronic acid, dextran and polyamino acids. Any combination, copolymer, polymer or blend thereof of the above examples is contemplated for use according to the present invention. Such bioabsorbable materials may be prepared by known methods.

Particularly useful biodegradable polymers include polylactides, poly-glycolides, polycarprolactone, polydioxane and their random and block copolymers. Examples of specific polymers include poly D, L-lactide, polylactide-co-glycolide (85:15) and polylactide-co-glycolide (75:25).

Preferably, the biodegradable polymers discussed above will have a molecular weight in the range of about 1,000 to about 1,000,000 g/mole, more preferably about 4,000 to about 250,000 g/mole. Blends of different molecular weight polymers are also contemplated. A small percentage of a low molar mass monomer can also be added to the higher molar mass polymer.

The methods and apparatus according to the invention are capable of producing membranes containing fibers having diameters in the range from about 10 up to about 1,000 nanometers, more preferably about 20 to about 500 nanometers.

It is also possible to produce membranes containing fibers having different diameters with a controlled percentage of sub-micron diameter fibers. Preferably, the membrane will contain at least about 10 wt % of sub-micron diameter fibers, more preferably at least about 80 wt %.

Membrane can also be produced containing fibers of different materials, e.g., different biodegradable and bioabsorable polymers.

Optionally, additives, e.g., one or more medicinal agents, can be incorporated into the fibers produced in accordance with the invention. The additives can be mixed with the fiberizable material, e.g., polymer, prior to formation of the fibers.

The chemical composition, i.e., specific polymers or blends of polymers, the fiber diameter, the membrane morphology and the porosity of the non-woven membrane can be controlled to provide selectable performance criteria for the membranes being produced. The membrane can also contain a plurality of fibers which have different medicinal agents or different concentrations of medicinal agents. Such membranes offer unique treatment options with combinations of medicinal agents and release profiles.

In one embodiment, the methods of the invention can provide a plurality of different layers. The layers can have the same or different chemical composition, fiber diameters, membrane morphology and porosity.

In such an embodiment, it is also contemplated that additives can be incorporated between the layers of the multi-layered membrane, instead of or in addition to, incorporating additives into the fiber structure itself.

Membranes can be prepared for use in applications where the membrane contains a high percentage of very small diameter fibers or where relatively high surface area to structure is desired. As a consequence of preparing membranes using the present invention, the structure of the membrane can be tailored to contain a highly controlled amount of very small diameter fibrils or to exhibit an increased surface area over similar membraneous structures prepared without the present invention. Moreover, the desired characteristics of the membranes can be maintained while producing the membranes at a rate higher than without the present invention.

Examples of membranes which exhibit the above described characteristics that can be produced according to the invention include medical devices or articles, such as drug delivery devices, adhesion-reducing barriers, scaffolding for guided tissue regeneration, anti-fibroblastic growth barriers, or nerve coaptation wraps, as well as non-medical devices or articles, such as separator membranes or current collectors useful in batteries or fuel cells. Further examples are described in co-pending, commonly owned patent application Ser. No. 09/859,007, entitled "Biodegradable and/or Bioabsorbable Fibrous Articles and Methods For Using The Articles For Medical Applications," filed on even date herewith.

EXAMPLES

The following non-limiting examples have been carried out to illustrate preferred embodiments of the invention. These examples include the preparation of membranes according to the invention, analysis of the membranes and testing of the membranes.

Example 1

Figure 13:
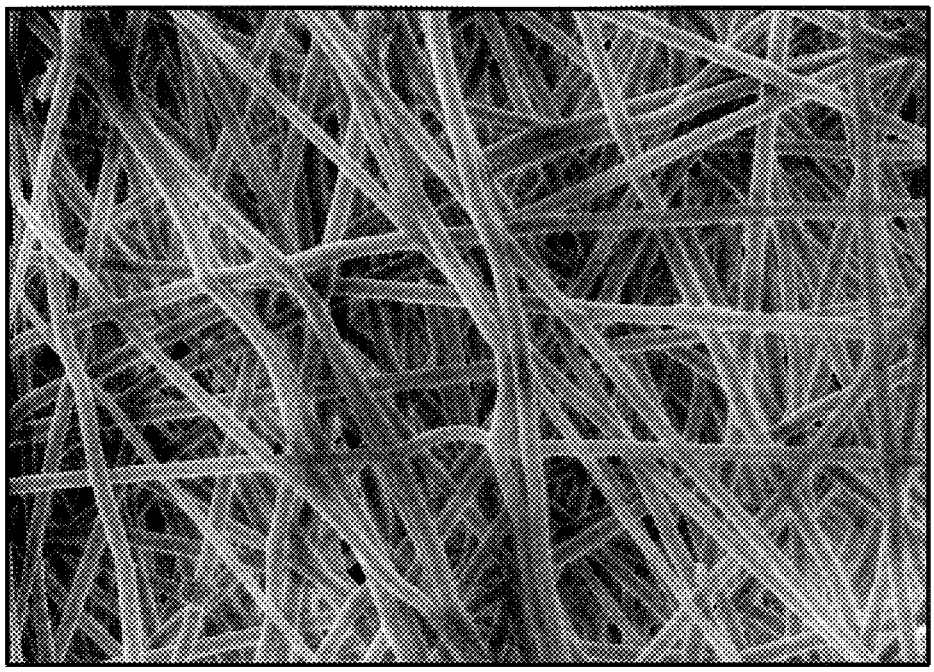
FIG. 13 is an SEM of a membrane described in Example 1.

A membrane according to the invention was prepared as follows: a 30 wt % PLG copolymer/DMF solution was prepared by slowly dissolving PLG copolymer pellets (inherent viscosity of 0.55–0.75. Birmingham Polymers Inc., AL) into an N,N-dimethyl formamide (DMF) solvent at room temperature. The solution was then loaded into the 5 ml syringe fitted with a gauge 20 needle, and delivered through a Teflon tube (0.03" ID) to the exit hole of an electrode having a diameter of 0.025". The solution was pumped and controlled by a syringe pump (Harvard Apparatus "44" series, MA) at a flow rate of 20 microliters/min. A 25 kV positive high voltage (by Glassman High Voltage Inc.) was applied on the electrode. The distance from the tip of the electrode to the grounded collecting plate was 15 cm. A tiny electrospinning jet was formed and stabilized in 30 seconds under these conditions. The collecting plate was movable and controlled by a stepper motor. The collecting plate was continually moved at a rate of 1 mm/sec until a membrane having a relatively uniform thickness of about 100 microns was obtained. An SEM (Scanning Electron Microscopy) image of the membrane is shown in FIG. 13.

Example 2

Figure 14:
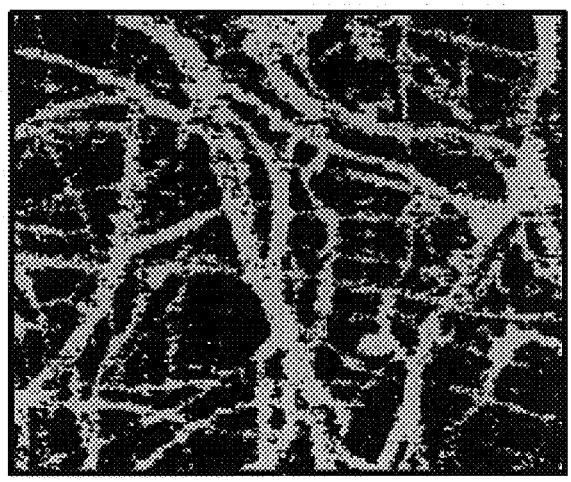
FIG. 14 is an SEM of a PAN membrane described in Example 2.

A membrane according to the present invention, fabricated by a multi-jet electrospinning process, was prepared as follows: an 8 wt % polyacrylonitrile (PAN) (Aldrich Chemical Company, Inc.)/DMF solution was prepared by slowly adding and dissolving the polymer powders into an organic solvent, which was DMF (N,N-dimethyl formamide), at room temperature. After the solution was completely mixed, it was then loaded into 6 individual syringes, each with a volume of 5 mL. The syringes were fitted with gauge 20 needles and the solution was delivered through Teflon tubes (0.03" ID) to 6 electrodes, each having a tiny hole with a diameter of 0.025". The geometry of the electrodes was designed in such a way so that the largest electric field strength could be achieved at the tip of the electrode under a given electric potential, which included a hemispherical tip with a radius of 0.125 inch and a central hole of 0.025 inch diameter. The polymer solution was finally pumped and controlled by a syringe pump (Harvard Apparatus "44" series, MA) at a flow rate of 25 microliters/min. In addition, a 26 kV positive high voltage (by Glassman High Voltage Inc.) was applied on the electrodes in order to obtain the existence of six well-stabilized electrospinning jets. The distance from the tip of the electrodes to the grounded collecting plate was 15 cm and the tip of the electrodes were 2 cm apart from each other. The collecting plate was movable and controlled by a step motor. The collecting plate was continually moved at a rate of 1 mm/sec until a bioabsorable and biodegradable PAN membrane having a relatively uniform thickness of about 100 microns was obtained. An SEM (Scanning Election Microscopy) image for the PAN membrane is shown in FIG. 14.

Example 3

A polymer solution suitable for electrospinning, which contained a drug, was prepared as follows: A sample of Poly(DL-lactide) ("PLA") purchased from Birmingham Polymers, Inc., Birmingham, Ala. (Product No. D98120) having a weight average molecular weight of $1.09\times10^5$ g/mole and a polydispersity of 1.42 was stored in a vacuum oven at room temperature. The pellets were dissolved in DMF purchased from Fisher Scientific, Fair lawn, N.J. to form a 25 wt % solution. The antibiotic drug used was Mefoxin™ from Merck & Co., Inc., West Point, Pa. The antibiotic was dissolved in distilled water and then mixed with PLA/DMF solution in appropriate amounts to form the solution with a PLA/drug ratio of 9:1. A stable jet was formed using this solution in the electrospinning process described in Example 1.

Example 4

Figure 15:
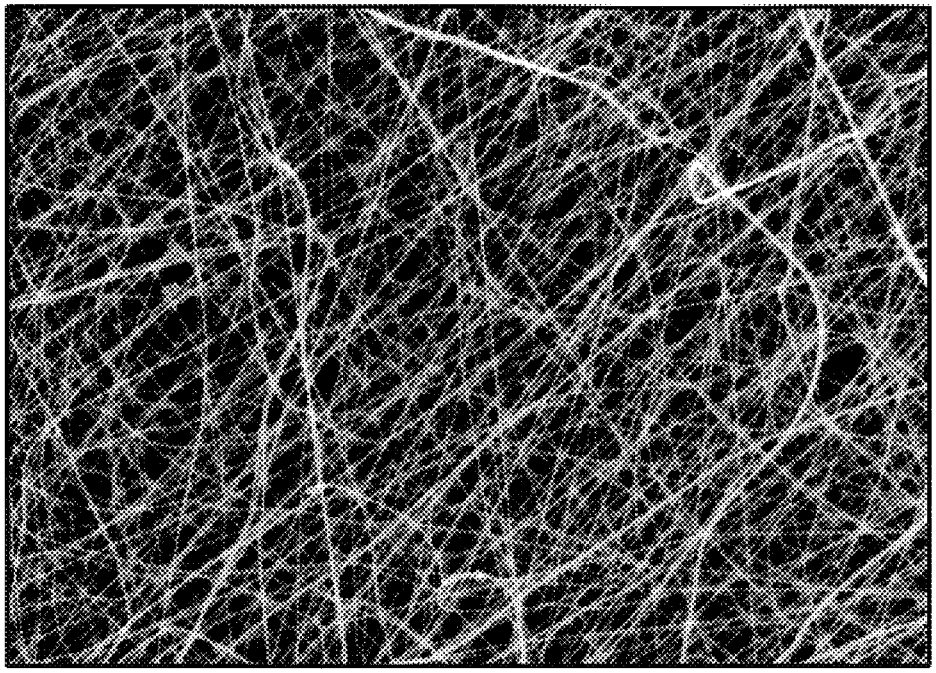
FIG. 15 is an SEM of a membrane described in Example 4.

A second membrane was prepared in a similar manner to Example 1, except that a drug solution was added to the polymer solution prior to electrospinning and the voltage applied to the electrode was adjusted. The drug solution was prepared by dissolving 0.6 grams of Mefoxin (Merck & Co Inc.) into 0.4 grams of water. The drug solution was then very slowly (dropwise) added to the polymer solution with gentle stirring until it reached a final PLG/drug ratio of 19:1. A 20 kV positive high voltage (by Glassman High Voltage Inc.) was applied on the electrode. All other parameters were the same as Example 1. An SEM (Scanning Electron Microscopy) image of the membrane containing the drug is shown in FIG. 15.

Example 5

A membrane was fabricated as follows: A 35 wt % PLA polymer/DMF solution was prepared by slowly dissolving the PLA pellets. The solution was fed through the syringe pump system to the electrodes at a flow rate of 20 microliter/min per jet. A 25 kV positive high voltage was applied to the electrode. FIG. 16 shows a typical scanning electron microscopy (SEM) image of an electrospun PLA membrane made by the procedures described above. It has an average fiber diameter of 200 nm. The typical membrane density is about 0.25 g/cm$^3$, as compared to the neat resin (PLA) density of 1.3 g/cm$^3$.

Example 6

A membrane containing dual thickness fibers was prepared as follows: a 25 wt % PLA-DMF solution was prepared by slowly dissolving PLA polymer pellets having the same molecular weight and poly dispersity as in Example 2 into a DMF solvent. The drug solution was then very slowly (dropwise) added to the polymer solution with gentle stirring until it reached a final PLG/drug ratio of 19:1. A 20 kV positive high voltage (by Glassman High Voltage Inc.) was applied on the electrode. All other parameters were the same as Example 1. A membrane having a network structure consisting of large size filaments (2 micron diameter), very fine fibrils (50 nanometer diameter) and small blobs was obtained by varying solution feeding speed ranging from 20 $\mu$l/min to 70 $\mu$l/min. An SEM of the resulting membrane is shown in FIG. 17.

Example 7

A biodegradable and bioabsorbable composite membrane consisting of two polymer components of different hydrophobicity according to the present invention was prepared as follows: First, a 6 wt % polyethylene oxide (PEO)/DMF solution was prepared by slowly adding the polymer powders into an organic solvent, which was DMF (N,N-dimethyl formamide). Second, a 30 wt % polylactide glycolide (PLG)/DMF solution was made by dissolving the polymers into DMF as well. After these two solutions were each completely homogenized at the room temperature, they were then loaded separately into two individual syringes, each with a volume of 5 mL. Next, the syringes were fitted with 2 gauge 20 needles and delivered through Teflon tubes to the electrodes, each having a tiny hole with a diameter of 0.025". The polymer solutions were finally pumped and controlled by a syringe pump at a flow rate of 20 microliters/min. In addition, a 25 kV positive high voltage was applied on two separate electrodes in order to obtain the existence of well-stabilized electrospinning jets. The distance from the tips of the electrodes to the ground collecting plate was 15 cm. Furthermore, a step motor was utilized in order to control the movement of the ground collector so that it was capable to move in different directions, either left or right. The collecting plate was moving at a rate of 5 steps/sec continuously until a biodegradable and bioabsorable membrane having a relatively uniform thickness of 100 microns was achieved.

Example 8

A biodegradable and bioabsorbable composite membrane consisting of two component polymer blend of different hydrophobicity according to the present invention was prepared as follows: First, a 2 wt % polyethylene oxide (PEO, Mw=100,000 g/mol)/DMF solution was prepared by slowly adding the polymer powders into an organic solvent, which was DMF (N,N-dimethyl formamide). Second, a 20 wt % polylactide glycolide (PLG)/DMF solution was made by dissolving the polymers into DMF as well. These two solutions were mixed together and were each completely homogenized at the room temperature. They were then loaded separately into two individual syringes, each with a volume of 5 mL. Next, the syringes were fitted with 2 gauge 20 needles and delivered through Teflon tubes to the electrodes, each having a tiny hole with a diameter of 0.025". The polymer solutions were finally pumped and controlled by a syringe pump at a flow rate of 20 microliters/min. In addition, a 25 kV positive high voltage was applied on two separate electrodes in order to obtain the existence of well-stabilized electrospinning jets. The distance from the tips of the electrodes to the ground collecting plate was 15 cm. Furthermore, a step motor was utilized in order to control the movement of the ground collector so that it was capable to move in different directions, either left or right. The collecting plate was moving at a rate of 5 steps/sec continuously until a biodegadable and bioabsorable membrane having a relatively uniform thickness of 100 microns was achieved.

Example 9

A polyimide membrane was prepared according to the present invention as follows: First, a solution was prepared by slowly dissolving pyrromelletic dianhydride (PMDA) and oxydianiline (ODA) in N,N-dimethylacetamide (DMAc) to provide a solution containing 10 wt % PMDA and 10 wt % ODA. The resulting solution was then reacted under condensation reaction conditions at a temperature of 50° C. for 30 minutes to provide a solution of poly(amic acid) pre-polymers. The yield was controlled to about 50% to avoid cross linking. The filtered and recovered poly(amic acid) solution contained about 10 wt % of solute. After the poly(amic acid) solution was completely homogenized at the room temperature, it was then loaded into a 5 ml syringe fitted with a gauge 20 needle and delivered through Teflon tubes to an electrode having a tiny hole with a diameter of 0.025". The pre-polymer solution was pumped and controlled by a syringe pump at a flow rate of 20 microliters/min. A 25 kV positive high voltage was applied on the electrode in order to obtain the existence of a well-stabilized electrospinning jet. The distance from the tip of the electrode to the ground collecting plate was 15 cm. A step motor was utilized in order to control the movement of the ground collector so that it was capable to move in different directions, either left or right. The collecting plate was moving at a rate of 1 mm/sec continuously until a poly(amic acid) membrane having a relatively uniform thickness of 100 microns was achieved.

The poly(amic acid) membrane then subjected to a post-curing step to convert the membrane to a polyimide membrane. In the post-curing step, the poly(amic acid) membrane was imidized by thermal conversion by maintaining the membrane at about 250° C. under a vacuum for 120 minutes. The resulting membrane was yellowish with a silky tissue-paper like texture and had excellent environmental stability.

Example 10

Membranes useful as a separators or current collectors for a battery or fuel cell were prepared by subjecting a PAN membrane (prepared according to Example 2) and a polyimide membrane (prepared according to Example 9) each to a post-conditioning step in which a conductive layer was applied to the surface of each of the membranes. Since the membranes were not electrically conductive, they were plated with a thin layer of metal (e.g. copper) to induce conductivity using an electroless plating procedure. Electroless plating refers to the autocatalytic or chemical reduction of aqueous metal ions plated to a base substrate. This technique has been routinely used for coating of an object (such as a plastic part) as a pretreatment step. Unlike conventional electroplating, no electrical current is required for deposition. Components of the electroless bath typically include an aqueous solution of metal ions, catalyst, reducing agent(s), complex agent(s) and bath stabilizer(s). In electroless plating, the substrate being plated must be catalytic in nature (usually induced by surface pre-treatment) and can induce the autocatalytic reaction in the bath to continuously deposit the metal. The metal ions are reduced to metal by the action of the reducing agents.

The following electroless plating procedure was used to coat the membranes with copper: In a first step, each membrane was immersed in an acidic aqueous solution of stannous chloride ($SnCl_2$) (0.06 g $SnCl_2$ in 20 ml $H_2O$) kept at 45° C. for 30 minutes. In a second step, each of the recovered membranes from step 1 were immersed in a palladium chloride ($PdCl_2$) solution (having a concentration of 1 mg/ml of $H_2O$) at 70° C. for 60 minutes. An electroless copper bath was prepared by combining 15 g/liter of copper sulfide (metal salt), 40 g/liter of Rochelle salt (complexing agent), 6 ml/liter of 37% formaldehyde (reducing agent) and 0.01 g/liter of vanadium oxide (stabilizer). The pH level of the bath was kept at about 12 and the bath temperature at 70–75° C. Each membrane recovered from step 2 was immersed in the electroless copper bath for 30 minutes. The plating rate of this bath was about 1 to 5 $\mu$m/hr, with a target layer thickness of less than 100 microns. As the fiber surface to volume ratio is extraordinarily high and the fiber diameter is small, the plating process did not cover the entire contour of the membrane surface evenly. However, with plating of a large fraction of the membrane surface to the desired thickness, the resulting membrane exhibited sufficient electric conductivity for battery and fuel cell applications as separator membranes and current collectors. An SEM of the resulting copper plated PAN membrane is shown in FIG. 18.

Thus, while there has been disclosed what is presently believed to be preferred embodiments of the invention, those skilled in the art will appreciate that other and further changes and modifications can be made without departing from the scope or spirit of the invention, and it is intended that all such other changes and modifications are included in and are within the scope of the invention as described in the appended claims.

We claim:

1. A method for electrospinning a polymer fiber from a conducting fluid containing said polymer in the presence of a first electric field established between a conducting fluid introduction device and a ground source comprising:

modifying said first electric field with a second electric field to form a jet stream of said conducting fluid and forming a polymer fiber.

2. A method according to claim 1, wherein said conducting fluid introduction device is a spinneret.

3. A method according to claim 1, wherein said second electric field is established by imposing at least one field modifying electrode.

4. A method according to claim 3, wherein said field modifying electrode is a plate electrode positioned between said conducting fluid introduction device and said ground source.

5. A method according to claim 3, further comprising controlling the electrical potential on the conducting fluid introduction device by adjusting the electric charge on said field modifying electrode.

6. A method according to claim 3, further comprising imposing a plurality of electrical field modifying electrodes, to provide a controlled distribution of electrostatic potential along the direction of flow of said jet stream.

7. A method according to claim 1, further comprising feeding said conducting fluid to said conducting fluid introduction device at a controlled rate.

8. A method according to claim 7, wherein said rate is controlled by maintaining said conducting fluid at a constant pressure or constant flow rate.

9. A method for electrospinning a polymer fiber from a conducting fluid containing a polymer in the presence of an electric field established between a spinneret and a ground source comprising:

a) forming an electrospinning jet stream of said conducting fluid; and b) electrically controlling the flow characteristics of said jet stream to provide a controlled pattern over a desired target area; and c) forming a polymer fiber from said jet stream.

10. A method according to claim 9, wherein said flow characteristics of said jet stream are electrically controlled by at least one electrode.

11. A method according to claim 9, wherein said flow characteristics of said jet stream are electrically controlled by at least one pair of electrostatic quadrupole lenses.

12. A method according to claim 11, wherein said flow characteristics of said jet stream are electrically controlled by a plurality of pairs of electrostatic quadropole lenses.

13. A method according to claim 12, wherein said flow characteristics of said jet stream are electrically controlled by using an alternating gradient technique.

14. A method according to claim 9, wherein said controlled pattern is provided by applying a waveform to the potential on at least one pair of electrostatic quadropole lenses.

15. A method for forming a controlled-dimension and controlled-morphology membrane by electrospinning a plurality of polymer fibers from a conducting fluid containing said polymer in the presence of an electric field established between a solution introduction device and a ground source, said method comprising:

a) forming a plurality of electrospinniflg jet streams of said conducting fluid;

b) independently controlling the flow characteristics of at least one of said jet streams; and c) forming a membrane.

16. A method according to claim 15, wherein said flow characteristics of at least one of said jet streams are controlled by at least one scanning electrode.

17. A method according to claim 15, wherein said flow characteristics of at least one or more of said jet streams are controlled by at least one pair of scanning electrodes.

18. A method according to claim 15, wherein said solution introduction device consists of a plurality of electrospinning spinnerets.

19. A method according to claim 18, wherein each spinneret produces an individual jet stream of said conducting fluid.

20. A method according to claim 19, wherein the flow characteristics of each individual jet stream is independently controlled.

21. A method according to claim 20, wherein each spinneret has at least one scanning electrode for electrically independently controlling the flow characteristics of each individual jet stream.

22. A method according to claim 21, wherein each spinneret has two pairs of scanning electrodes for electrically controlling the flow characterists of each individual jet stream.

23. A method according to claim 18, wherein at least two spinnerets deliver different conducting fluids.

24. A method according to claim 23, wherein said different conducting fluids refers to different concentrations of polymer, different polymers, different polymer blends, different additives and/or different solvents.

25. An electrospinning apparatus for forming a membrane, comprising:

a conducting fluid introduction device for providing a quantity of conducting fluid containing a polymer, said conducting fluid introduction device comprising a plurality of electrospinning spinnerets for delivering said conducting fluid, said spinnerets being electrically charged at a first potential;

a ground member positioned adjacent said spinnerets and electrically charged at a second potential different from said first potential, thereby establishing an electric field between said spinnerets and said ground member;

a support member disposed between said spinnerets and said ground member and movable to receive conducting fluid from said spinnerets; and means for controlling the flow characteristics of conducting fluid from at least one spinneret independently from the flow of conducting fluid from another spinneret.

26. An electrospinning apparatus according to claim 25, wherein said means for independently controlling the flow characteristics comprises at least one electrode disposed adjacent each spinneret, each electrode being charged at a potential different from and separate from said first potential.

27. An electrospinning apparatus according to claim 26, wherein each spinneret has two pairs of scanning electrodes for electrically separately directing the flow characteristics of conducting fluid from said spinneret.

28. An electrospinning apparatus according to claim 26, further comprising a probe associated with at least one spinneret, said probe being disposed between said electrode and said ground member, said probe being electrically charged at a potential different from said spinneret and said electrode.

29. An electrospinning apparatus according to claim 25, wherein said means for independently controlling said flow characteristics comprises a means for individually electrically turning on and off a respective spinneret.

30. An electrospinning apparatus according to claim 29, wherein said means for individually electrically turning on and off a respective spinneret comprises at least one scanning electrode associated with each spinneret.

31. An electrospinning apparatus according to claim 25, wherein said means for independently controlling said flow characteristics comprises a means for applying an alternating gradient to said conducting fluid delivered from said spinnerets.

32. An electrospinning apparatus according to claim 31, wherein said means for applying said alternating gradient comprises a plurality of pairs of electrostatic quadropole lenses.

33. An electrospinning apparatus according to claim 25, wherein said apparatus further comprises a pump for supplying conducting fluid to said solution introduction device at a predetermined pressure.

34. An electrospinning apparatus according to claim 33, wherein said pump is adapted to control the supply rate of conductive fluid at a constant flow rate.

35. An electrospinning apparatus according to claim 33, wherein said pump is adapted to control the supply of conductive fluid at a constant pressure.

36. An electrospinning apparatus according to claim 25, wherein said apparatus comprises a pump system for supplying different conducting fluids to at least two individual spinnerets.

37. An electrospinning apparatus according to claim 25, wherein said solution introduction device comprises a slit-die defining said plurality of spinneret.

38. An electrospinning apparatus according to claim 37, wherein adjacent spinnemets are interconnected by slits.

39. An electrospinning apparatus according to claim 38, wherein said spinnerets are defining by openings in said slit-die and said slits interconnecting said spinnerets are of configurations smaller than said openings.

40. An electrospinning apparatus according to claim 37, further comprising a plurality of scanning electrodes disposed adjacent to each of said spinnerets.

41. An electrospinning apparatus according to claim 25, wherein said solution introduction device comprises a matrix defining said plurality of spinnerets, said spinnerets being disposed in said matrix in electrical isolation from each other.

42. An electrospinning apparatus according to claim 41, wherein at least two individual spinnerets are electrically charged to a different potential.

43. An electrospinning apparatus according to claim 41, further comprising a plurality of individual electrodes wherein at least one individual electrode is disposed adjacent to each individual spinneret.

44. An electrospinning apparatus according to claim 43, wherein at least two of said individual electrodes are electrically charged to a different potential.

45. In an electrospinning apparatus for forming a membrane by electrospinning a plurality of polymer fibers from a conducting fluid which contains a polymer in the presence of an electric field between a conducting fluid introduction device and a ground source, an improved solution introduction device comprising:

a plurality of spinnerets, each for independently delivering a controlled quantity of conducting fluid at a constant pressure or constant flow rate, said spinnerets being charged at an electric potential and being disposed relative to each other to normally interfere with the electric field produced by adjacent spinnerets, each of said spinnerets having a tip at which conducting fluid exits configured to have an electrostatic field strength at each tip stronger than the liquid surface tension at each of said tips.

46. An improved solution introduction device according to claim 45, wherein each spinneret tip is configured by having a selected geometric profile, a selected spatial relationship relative to other spinneret tips or a combination of both.

47. An improved solution introduction device according to claim 46, further comprising an electrode associated with each spinneret configured to produce an electrical potential to at least partially screen electric field interference from adjacent spinnerets.

48. An improved solution introduction device according to claim 45, further comprising a means for at least partially shielding each spinneret tip from electric field interference from adjacent spinnerets.

49. An improved solution introduction device according to claim 48, wherein said means for at least partially shielding is a physical barrier disposed between adjacent spinnerets.

50. An improved solution introduction device according to claim 49, wherein said physical barrier has a conical shape.

* * * * *

UNITED STATES PATENT AND TRADEMARK OFFICE

CERTIFICATE OF CORRECTION

PATENT NO. : 6,713,011 B2
DATED : March 30, 2004
INVENTOR(S) : Chu et al.

It is certified that error appears in the above-identified patent and that said Letters Patent is hereby corrected as shown below:

Column 1,
Line 4, insert: -- "This invention was made with government support under the following Grant Nos. DAAG559710022 awarded by the U.S. Army Research Office and DEFG0286ER45237.015 awarded by the U.S. Department of Energy. The Government has certain rights in the invention." --

Signed and Sealed this

Sixth Day of July, 2004

JON W. DUDAS
*Acting Director of the United States Patent and Trademark Office*

UNITED STATES PATENT AND TRADEMARK OFFICE

CERTIFICATE OF CORRECTION

PATENT NO. : 6,713,011 B2
DATED : March 30, 2004
INVENTOR(S) : Chu et al.

It is certified that error appears in the above-identified patent and that said Letters Patent is hereby corrected as shown below:

Column 9,
Line 32, now reads “spirmeret tip as discussed above.”, and should read -- spinneret tip as discussed above. --;

Column 20,
Line 1, now reads “a plurality of electrospinniflg”, and should read -- a plurality of electrospinning --;

Column 21,
Line 36, now reads “adjacent spinnemets are”, and should read -- adjacent spinnerets are --.

Signed and Sealed this

Twelfth Day of October, 2004

JON W. DUDAS
*Director of the United States Patent and Trademark Office*